US007117711B2

(12) United States Patent
Feijen

(10) Patent No.: US 7,117,711 B2
(45) Date of Patent: Oct. 10, 2006

(54) ADJUSTABLE MOULD

(75) Inventor: Hendricus Hubertus Feijen, Lanaken (BE)

(73) Assignee: Acera, S.A., Great Duchy (LU)

( * ) Notice: Subject to any disclaimer, the term of this patent is extended or adjusted under 35 U.S.C. 154(b) by 401 days.

(21) Appl. No.: 10/489,714

(22) PCT Filed: Jun. 19, 2002

(86) PCT No.: PCT/EP02/07094

§ 371 (c)(1),
(2), (4) Date: Mar. 15, 2004

(87) PCT Pub. No.: WO04/000478

PCT Pub. Date: Dec. 31, 2003

(65) Prior Publication Data

US 2004/0241272 A1 Dec. 2, 2004

(51) Int. Cl.
*B21D 31/00* (2006.01)

(52) U.S. Cl. ..... 72/389.4; 72/478; 425/398; 249/155; 249/157

(58) Field of Classification Search ..... 425/383, 425/394, 395, 403, 398; 249/155, 157; 72/389.4, 72/413, 473, 478
See application file for complete search history.

(56) References Cited

U.S. PATENT DOCUMENTS 5,249,452 A 10/1993 Baldwin et al.

FOREIGN PATENT DOCUMENTS

SU 496072 12/1975

*Primary Examiner*—Joseph S. Del Sole
*Assistant Examiner*—Maria Veronica Ewald
(74) *Attorney, Agent, or Firm*—Jacobson Holman PLLC

(57) ABSTRACT

The present invention relates to a mould (42) for bending material parts, the mould (42) comprising opposite first and second longitudinally extending mould halves (1, 21) enclosing a longitudinal mould cavity (59). The first mould halve (1) comprises a plurality of parallel first plates (2), and the second mould halve (21) comprises a plurality of parallel second plates (22). The first and second plates (2, 22) extend in width direction of the mould (42), alternate in longitudinal direction of the mould (42) and comprise respectively a first and second end wall (5, 25). Consecutive first and second end walls (5, 25) form respectively first and second side walls (3, 23) on opposite sides of the mould cavity (59). Consecutive first plates (2) are positioned at a distance from each other such as to receive in a first space (20) between adjacent first plates (2) at least part of a second plate (22), and consecutive second plates (22) are positioned at a distance from each other such as to receive in a second space (40) between adjacent second plates (22) at least part of a first plate (2). Each first plate (2) comprises a first bottom part (8) and each second plate (22) comprises a second bottom part (28), the first and second bottom parts (8, 28) protruding from the first and second end wall (5, 25) towards the mould cavity (59) and comprising respectively a first and second end part (10, 30). Further, each first plate (2) comprises means (11) which co-operate with the bottom part (28) of an adjacent second plate (22) for restricting the canting of an adjacent second plate (22) in such a way that the second end part (30) would be moved in height direction of the mould (42), and each second plate (22) comprises means (31) which co-operate with the bottom part (8) of an adjacent first plate (2) for restricting the canting of an adjacent first plate (2) in such a way that the first end part (10) would be moved in height direction of the mould (42), when pressing a material part in the mould cavity (59) for the purpose of bending the material part. (FIG. 2)

13 Claims, 1 Drawing Sheet

ADJUSTABLE MOULD

This is a nationalization of PCT/EP02/07094 filed Jun. 19, 2002 and published in English.

The present invention relates to a mould for bending material parts according to the preamble of the first claim.

Such a mould is known from the Russian patent publication SU-496072. The mould disclosed in SU-496072 comprises a mould cavity and a first and second mould halve on opposite sides of the mould cavity. The first and second mould halve each comprise a plurality of parallel first and second plates, which define a first and second inner longitudinal side wall on opposite sides of the mould cavity. The first and second plates extend in width direction of the mould and alternate in longitudinal direction of the mould. Each first plate comprises a first inner side wall and each second plate comprises a second inner side wall. The first side walls of consecutive first plates form the first inner side wall and the second side walls of consecutive second plates form the second inner side wall of the mould cavity. The first and second mould halves are carried on respectively a first and second carrier. These carriers are positioned on a base and are displaceable with respect to each other to widen or narrow the mould cavity. The first and second plates have a first and second base substantially parallel to the mould base. In order to allow producing V-shaped parts from material parts, e.g. a flat plate or a profile, the first and second plates forming the side walls of the mould cavity have a sloping side.

A flat plate or other material part is bent by positioning the plate above the mould cavity and moving a stamp downwards to push the flat plate into the mould cavity.

The disadvantage with the mould as disclosed in the Russian patent publication SU-496072 is that the mould is not suitable for bending plates such that the angle between the bent sides is smaller than 90°. Indeed, to bend a plate until the angle between the bent sides is smaller than 90°, the material part has to be pressed deep into the mould cavity, as a consequence of which the mould halves cant around the bottom corner edge of their outer side walls. As a consequence thereof, the depth over which the plate to be bent can be pressed into the mould cavity is insufficient, the angle between opposite sides of the bent material often too large.

The present invention now meets the needs of providing a mould with which plates or other material parts may be bent such that the angle between the two sides of the bent plate is smaller than 90°.

This is achieved with the technical features of the first claim.

The first and second plates of the mould of the present invention comprise a first and second bottom part that protrudes from respectively the first and second inner longitudinal side wall defining the mould cavity, in width direction of the mould, or in other words in the direction of the mould cavity. The bottom part of each first and second plate has respectively a first and second end part on a side pointing to the mould cavity. Further, each first plate comprises means which co-operate with the bottom part of an adjacent second plate for restricting the canting of an adjacent second plate in such a way that the second end part would be moved in height direction of the mould when pressing a material part in the mould cavity for the purpose of bending a plate. Similarly, each second plate comprises means which co-operate with the bottom part of an adjacent first plate for restricting the canting of an adjacent first plate in such a way that the first end part would be moved in height direction of the mould, when pressing a material part in the mould cavity for the purpose of bending the material part.

An analysis of the problem associated with bending plates or other material parts in a mould, has revealed that in the course of the bending operation, when forcing the central part of the material part downward in the mould, the inner longitudinal side walls of the mould cavity are subjected to a force perpendicular to the side walls. The vector corresponding to this force can be decomposed in two components: (1) a horizontal component parallel to the width direction of the mould and pointing away from the mould cavity, and (2) a vertical downward pointing component. When bending a plate or another material part such that the angle between the sides of the bent part is larger than or equal to 90°, the vertical force component will be larger than the horizontal component. When, however, pushing the material part deeper into the mould cavity to bend it to an angle smaller than 90°, the decomposition of the perpendicular force on the longitudinal side walls results in a horizontal component which is larger than the vertical component. The deeper the material part is pushed into the mould cavity, the larger this horizontal component becomes, and the larger the risk to canting of the plate around the longitudinal axis of the corresponding mould halve.

By the presence of the restricting means, the canting of a plate about the longitudinal axis of the mould halve in such a way that the end part would be moved in height direction of the mould, is counteracted. As a consequence, the risk to increasing of the angle between the inner longitudinal side walls of the mould cavity may be minimised. As the canting of the plates around the longitudinal axis of the corresponding mould halve would involve a decrease of the depth of the mould cavity, the depth over which the material could be pressed into the mould cavity would decrease correspondingly. In the present invention however, this is counteracted by the presence of the restricting means. Both effects contribute to the result that material parts may be bent to such an extent that after bending, the angle in between the sides of the bent material part is smaller than 90°.

The means for limiting the canting of the plates allow bending a metal plate or another material part and pushing it into the mould cavity to a position where the horizontal component of the force vector acting on the cavity wall becomes larger than the vertical component. This was not possible with the prior art device.

Preferably, the means for restricting the canting of the first and second plates comprises a first and second protrusion extending in longitudinal direction of the mould, the first and second protrusions being positioned on a first transversal side wall of respectively the first and second plate, the said protrusions being shifted in height direction of the mould in such a way as to receive between it and a bottom of the mould at least part of respectively the second and first end part.

The invention is further elucidated in the following figures and description of the figures.

Figures 1, 2, 3, 4, 5, 6, 7:
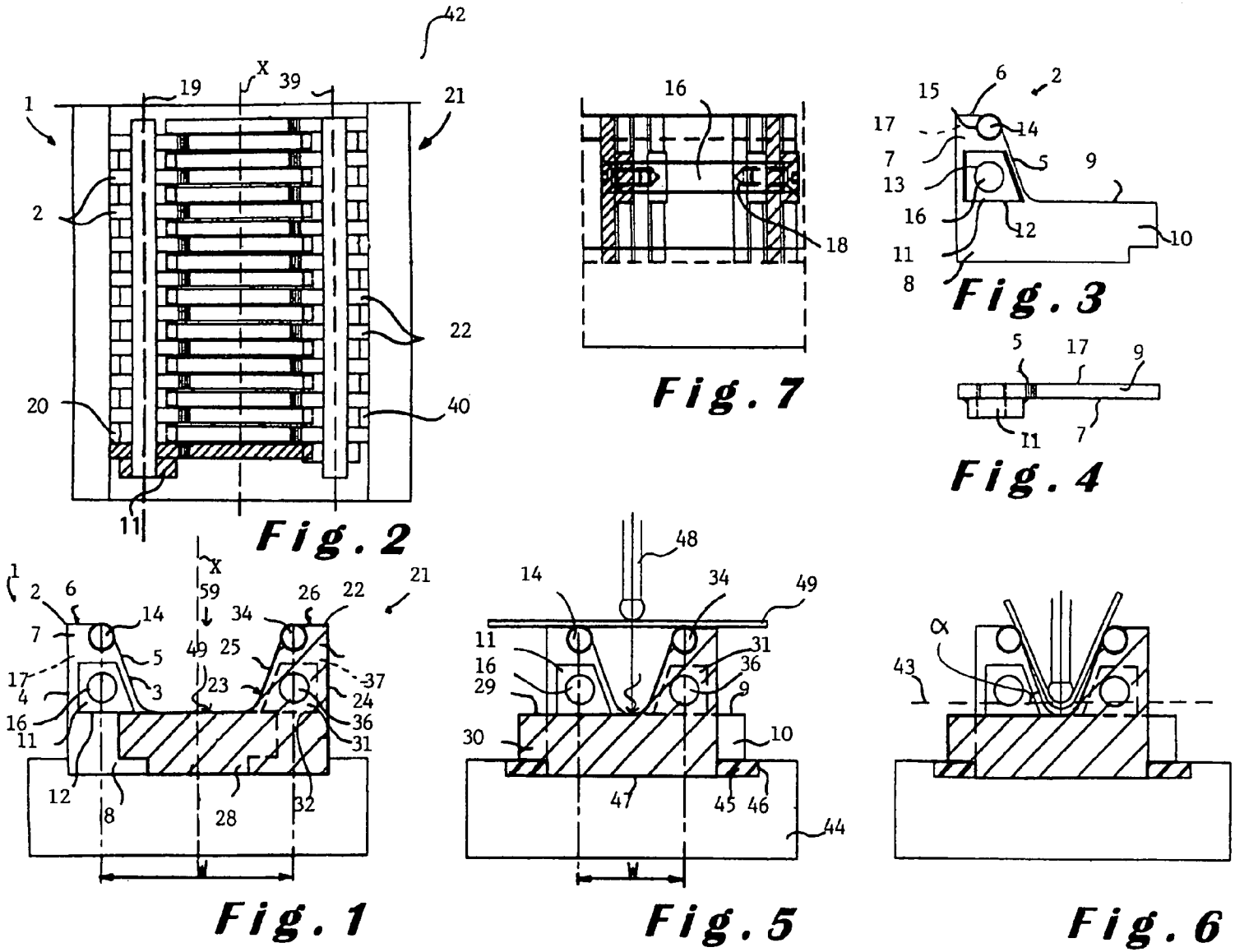
FIG. 1 is a cross section in height direction of the mould of this invention.
FIG. 2 shows a top view to the mould shown in FIG. 1.
FIG. 3 shows a front side of a plate as a part of the mould.
FIG. 4 is a top view of the plate of FIG. 3.
FIGS. 5–6 are a cross section of the mould shown in FIG. 1, the mould halves being at a smaller distance in width direction of the mould with respect to each other as compared to the mould shown in FIG. 1.
FIG. 7 shows a cross-section in longitudinal direction of a part of the mould, part of the plates not shown.

As can be seen from FIG. 1, the device of this invention comprises a mould 42 and a base 44. The mould 42 is received in an opening in the base 44.

The mould 1 comprises a mould cavity 59, and a first 1 and second 21 mould halve on opposite sides of the mould cavity 59. The first 1 and second 21 mould halves define respectively a first 3 and a second 23 inner longitudinal side wall on opposite sides of the mould cavity 59, and a first 4 and second 24 outer longitudinal side wall of the mould 42. The mould cavity 59 has a cavity bottom 49 with a longitudinal axis.

The opposed first 3 and second 23 inner side walls are sloping with respect to a vertical plane X dividing the mould cavity 59 in two parts and each time point away from the cavity bottom 49 towards the top of the inner side walls 3, 23. In this way, the distance in width direction of the mould 42 between the first 3 and second 23 inner side wall increases when moving away from the cavity bottom 49. The angle $\alpha$ between the first 3 or second 23 side wall and a horizontal 43 is preferably larger than 45° in order to enable the bending of material parts until the angle in between the sides of the bent material part is smaller than 90°. In the case the first 3 and second 23 side walls are positioned under an angle of 90° with respect to the horizontal 43, material parts may be bent having an angle of 0° in between the sides.

As is shown in FIG. 2, the first and second mould halve 1, 21 each comprise a plurality of respectively parallel first 2 and second 22 plates. Consecutive first plates 2 are positioned at a distance from each other approximately equal to the thickness of a plate 2. Similarly, consecutive second plates 22 are positioned at a distance from each other approximately equal to the thickness of a plate 22. As a consequence, each first plate 2 is adjacent the following second plate 22 of the opposite mould halve, and vice versa. However, the distance between consecutive first plates 2 and between consecutive second plates 22 may also be larger.

The first 2 and second 22 plates extend in width direction of the mould 42. They are positioned substantially vertical with respect to the base 44. The first 2 and second 22 plates alternate in longitudinal direction of the mould 42.

The thickness of the first and second plates 2, 22 may vary within wide ranges and will in general be adapted by the skilled person to the order of magnitude of the forces inferred by the inner longitudinal side walls 3, 23 in the course of the bending operation. If so desired, at different positions in the mould 42 the plates 2, 22 may have a different thickness.

As can be seen from FIG. 1, the first 2 and second 22 plates have a first 5 and second 25 sloping end wall. The first 5 and second 25 sloping end walls of respectively consecutive first 2 and second 22 plates respectively form opposite first 3 and second 23 sloping inner side walls of the mould 42.

The first 2 and second 22 plates comprise respectively a first 8 and second 28 bottom part, which protrudes from respectively the first and second end wall 5, 25 and the first and second side 3, 23 wall towards the mould cavity 59 in width direction of the mould 42. The first bottom parts 8 comprise a first end part 10 on a side of the bottom part pointing to the second outer side wall 24 of the mould 1. Similarly, the second bottom parts 28 comprise a second end part 30 on a side of the bottom part pointing to the first outer side wall 4 of the mould 1. The first 8 and second 28 bottom parts further respectively have a first 9 and second 29 horizontal top face which may be e.g. substantially parallel to the base 44 of the mould 42 and the bottom 49 of the mould cavity 59.

Further, each first plate 2 comprises means which co-operate with the bottom part 29 of an adjacent second plate 22 for restricting the canting of an adjacent second plate 22 in such a way that the second end part 30 would be moved in height direction of the mould 42 when pressing a material part in the mould cavity 59 for the purpose of bending a plate. Similarly, each second plate 22 comprises means which co-operate with the bottom part 9 of an adjacent first plate 2 for restricting the canting of an adjacent first plate 2 in such a way that the first end part 10 would be moved in height direction of the mould 42, when pressing a material part in the mould cavity 59 for the purpose of bending the material part.

In a preferred embodiment of the invention, the means for restricting the canting of the first and second plates 2, 22 comprise a first and second protrusion 11, 31 extending in longitudinal direction of the mould 42. The first and second protrusions 11, 31 are positioned on a first transversal side wall 7, 27 of respectively the first and second plate 2, 22. The protrusions 11, 31 are shifted in height direction of the mould 42 in such a way as to receive between it and a bottom 47 of the mould 42 at least part of respectively the second 30 and first 10 end part of.

As can be seen from FIG. 2 and 4, each first and second plate 2, 22 comprises a front side 7, 27 and a back side 17, 37 extending in width direction of the mould 42. At the front side 7, 27 of respectively the first 2 and second 22 plate, a four-sided protrusion 11, 21 is present. The protrusion 11, 31 may however also be positioned at the back side 17, 37 of the plate 2, 22, or at both sides. The protrusion 11, 31 may however also have another shape, for instance a triangular, or a round shape. In the preferred embodiment shown here, the protrusion is a quadrangle, having two parallel sides.

The protrusion 11 of a plate 2 of the first mould halve 1 preferably has a bottom face 12 that is substantially parallel to the horizontal top face 29 of the bottom part 28 of an adjacent second plate 22 belonging to the opposite mould halve 21. Similarly, the protrusion 31 of a plate 22 of the second mould halve 21 preferably has a bottom face 32 that is substantially parallel to the horizontal top face 9 of the bottom part 8 of an adjacent first plate 2 belonging to the opposite mould halve 1.

The protrusion 11, 31 protrudes from the front 7, 27 and/or back 17, 37 side of the first 2 and second 22 plate in longitudinal direction of the mould 42 towards respectively the adjacent second 22 and first 2 plate.

The distance over which the protrusion 11, 31 extends in longitudinal direction of the mould 42, i.e. the thickness of the protrusion, is preferably at least equal to the thickness of the plate 2, 22. The protrusion 11 may however also extend over a distance smaller or larger than the thickness of a plate 2. As can be seen from FIGS. 2 and 4, the thickness of the protrusion 11, 31 is approximately equal to the thickness of the plate 2, 22. As a result, in case the protrusion 11 is present on the front side 7 of a plate 2 of the first mould halve 1, the back side 17 of a consecutive plate 2 belonging to the same mould halve 1 contacts the front side of the protrusion 11. Similarly, in case the protrusion 31 is present on the front side 27 of a plate 22 of the second mould halve 21, the back side 37 of a consecutive plate 22 belonging to the same mould halve 21 contacts the front side of the protrusion 31. The distance over which the protrusion 11, 31 extends in longitudinal direction of the mould 42 will in general be adapted by the skilled person to the order of magnitude of the forces inferred by the longitudinal side walls 5, 25 in the course of the bending operation.

The mould halves 1, 21 are displaceable with respect to each other in width direction of the mould 42. The mould halves 1, 21 may be moved towards or away from each other as shown by the arrows in FIG. 1. Thereby, the first and second plates 2, 22 of respectively the first and second mould halve 1, 21 extend to a smaller or larger extent in the free space 40, 20 present between respectively consecutive second and first plates 22, 2 of respectively the second and first mould halve 21, 1. This allows varying the distance between the first 5 and second 25 inner side walls on opposite sides of the mould cavity 59. The larger the thickness of the material part to be bended, the larger the distance between the first 5 and second 25 inner side walls must be for bending material parts to the same extent. Thus, for bending a material part with a large thickness such that the angle between the two sides of the bent plate is for example 60°, the distance between the first 5 and second 25 inner side walls must be larger than for bending a plate with a smaller thickness to that extent. The width of the cavity bottom 49 in width direction of the mould 42 is varied accordingly. The distance between the first 5 and second 25 inner side walls, or the width of the cavity bottom 49, determines the width w of the mould cavity 59.

The moving of the mould halves 1, 21 towards or away from each other may be done by turning a screw (not shown), or by means of a hydraulic system. However, any other means known to the man skilled in the art may also be used. Once the mould halves 1, 21 are displaced with respect to each other until the desired distance between them is reached, the mould halves 1, 21 may be fixed in the desired position by means of one or more adjusting blocks 45 positioned between the outer side walls 4, 24 of the mould halves 1, 21 and the delimiting edges 46 of the opening in the base 44. However, this may also be done in any other way known to the man skilled in the art.

Preferably, the first bottom face 12 of the first protrusion 11 of each first plate 2 contacts the second top face 29 of the second bottom part 28 of the adjacent second plate 22 over at least a part of its length, in each position of the mould halves 1, 21 with respect to each other. Similarly, the second bottom face 32 of the second protrusion 31 of each second plate 22 contacts the first top face 8 of the first bottom part 9 of the adjacent first plate 2 over at least a part of its length, in each position of the mould halves 1, 21 with respect to each other. In this way, the upward movement of the first and second end part 10, 30 can be restricted in each position of the mould halves 1, 21 with respect to each other.

As shown in FIG. 1, the top face 9 of the bottom part 8 of each first plate 2 of the first mould halve 1 can slide below the bottom face 32 of the protrusion 31 of an adjacent second plate 22 of the second mould halve 21 positioned behind the first plate 2 in longitudinal direction of the mould 42. The presence of these protrusions 31 thus limits the canting of each first plate 2 about a longitudinal axis 19 of the first mould halve 2 in such a way that the first end part 10 of the first plate 2 would be moved in height direction of the mould 42 when pressing a material part in the mould cavity 59. In other words, the presence of these protrusions 31 restricts the upward movement of the first end part 10. Similarly, the top face 29 of the bottom part 28 of each second plate 22 of the second mould halve 21 can slide below the bottom face 12 of the protrusion 11 of an adjacent first plate 2 of the other mould halve 1 positioned behind the second plate 22. The presence of these protrusions 11 thus limits the canting of the second plate 22 about a longitudinal axis 39 of the second mould halve 21 in such a way that the second end part 30 of the second plate 22 would be moved in height direction of the mould 42 when pressing a material part in the mould cavity 59. In other words, the presence of these protrusions 11 restricts the upward movement of the second end part 30. It is clear that the protrusions 11, 31 may also have any other shape, or may be at any other position that is suitable to allow the restricting of the canting of the plates 2, 22.

The width w of the mould cavity 59 can be adjusted depending on the thickness of the material part to be bend. The maximal width w must however be chosen in such a way that the bottom face 12 of the protrusion 11 of each first plate 2 still contacts the top face 29 of the bottom part 28 of the adjacent second plate 22 over at least a part of its length, and that the bottom face 32 of the protrusion 31 of each second plate 22 still contacts the top face 9 of the bottom part 8 of the adjacent first plate 2 over at least a part of its length. Otherwise, the restricting of the canting of the plates 2, 22 can no longer be achieved. The smallest possible distance between the opposite mould halves 1, 21 is determined by the geometry of the mould 42.

The first and second longitudinal side walls 3, 23 of the mould cavity 59 respectively comprise first and second means 14, 34 for guiding a material part when being pressed into the mould cavity 59. The presence of these first and second guiding means 14, 34 allows minimising damage to the material part which is pressed into the mould cavity 59.

Each first and second plate 2, 22 respectively comprises a first and second recess 15, 35 for respectively receiving the first and second means 14, 34 at a position where the top face 6, 26 of the first respectively second plate 2, 22 transfers to the first, respectively, second, end wall 5, 25.

Since the consecutive plates 2, 22 of each mould halve 1, 21 comprise the same recess 15, 35, each mould halve 1, 21 has a groove extending in longitudinal direction of the mould 42. This groove is however each time interrupted between two consecutive plates 2, 22 of one mould halve 1, 21 over a distance which is at least equal to the thickness of a plate 2, 22. In the groove of the first and second mould halve 1, 21, respectively a first and second axle 14, 34 extending in longitudinal direction of the mould 42 is received. The first and second axle 14, 34 is rotatable about its longitudinal axle such that the material to be bent is guided upon being pushed into the mould cavity 59. In this way, damage to the material part may be minimised.

Preferably, the first and second mould halve 1, 21 respectively comprise first and second connecting means 16, 36, 18, 38, 13, 33 for removably connecting respectively the first and second plates 2, 22.

These first and second connecting means 16, 36, 18, 38, 13, 33 respectively comprise a first and second axle 16, 36 extending in longitudinal direction of the mould 42, a first and second cavity 13, 33 extending throughout respectively the first and second protrusion 11, 31 and the first and second plate 2, 22 for receiving respectively the first and second axle 16, 36, and means 18, 38 for connecting the first and second axle 16, 36 to the plate 2, 22'. These means 18, 38 may for instance be a screw as can be seen from FIG. 7. Any other tightening means known to the man skilled in the art may however also be used. In this way, a rigid connection between the plates 2, 22 of one mould halve 1, 21 is obtained.

A flat plate or another material part is bent by positioning the plate 49 above the mould cavity 59 (shown in FIG. 5) and moving a stamp 48 downwards to force the central part of the flat plate 49 into the mould cavity 59 (shown in FIG. 6). Thereby, the material part is positioned on top of the first and second top face 6, 26. As a consequence, the bottom face of the material part contacts the axles 14, 34 at two positions over the entire length of the material part. As the central part of the material part is forced into the mould cavity 59, the axle 14, 34 rotates around its longitudinal axis, thereby guiding the material into the mould cavity 59. When forcing the material part into the mould cavity 59, the inner longitudinal side walls 3, 23 of the mould cavity 59 are subjected to a force perpendicular to the side walls. As the plate is pushed deeper into the mould cavity for bending to bend it to an angle smaller than 90°, the decomposition of the perpendicular force acting on the inner longitudinal side walls 3, 23 results in a horizontal component which is larger than the vertical component. The deeper the material part is pushed into the mould cavity 59, the larger this horizontal component becomes. The canting of the plates 2, 22 as a result of these high sideway forces is restricted by the means described above.

The invention claimed is:

1. A mould (42) for bending material parts, the mould (42) comprising opposite first and second longitudinally extending mould halves (1, 21) enclosing a longitudinal mould cavity (59), the first mould halve (1) comprising a plurality of parallel first plates (2), the second mould halve (21) comprising a plurality of parallel second plates (22), the first and second plates (2, 22) extending in width direction of the mould (42), alternating in longitudinal direction of the mould (42) and comprising respectively a first and second end wall (5, 25), consecutive first and second end walls (5, 25) forming respectively first and second side walls (3, 23) on opposite sides of the mould cavity (59), consecutive first plates (2) being positioned at a distance from each other such as to receive in a first space (20) between adjacent first plates (2) at least part of a second plate (22), consecutive second plates (22) being positioned at a distance from each other such as to receive in a second space (40) between adjacent second plates (22) at least part of a first plate (2), characterized in that each first plate (2) comprises a first bottom part (8) and each second plate (22) comprises a second bottom part (28), the first and second bottom parts (8, 28) protruding from the first and second end wall (5, 25) towards the mould cavity (59) and comprising respectively a first and second end part (10, 30), in that each first plate (2) comprises means (11) which co-operate with the bottom part (28) of an adjacent second plate (22) for restricting the canting of an adjacent second plate (22) in such a way that the second end part (30) would be moved in height direction of the mould (42), in that each second plate (22) comprises means (31) which co-operate with the bottom part (8) of an adjacent first plate (2) for restricting the canting of an adjacent first plate (2) in such a way that the first end part (10) would be moved in height direction of the mould (42), when pressing a material part in the mould cavity (59) for the purpose of bending the material part.

2. A mould as claimed in claim 1, characterized in that the means for restricting the canting of the first and second plates (2, 22) comprise a first and second protrusion (11, 31) extending in longitudinal direction of the mould (42), the first and second protrusions (11, 31) being positioned on a first transversal side wall (7, 27) of respectively the first and second plate (2, 22), the said protrusions (11, 31) being shifted in height direction of the mould (42) in such a way as to receive between it and a bottom (47) of the mould (42) at least part of respectively the second (30) and first (10) end part.

3. A mould as claimed in claim 2, characterized in that each of the first and second protrusions (11, 31) has respectively a first and second bottom face (12, 32), each of the first and second bottom parts (8, 28) respectively comprise a first and second top face (9, 29), the first and second bottom face (12, 32) being substantially parallel to respectively the second and first top face (29, 9).

4. A mould as claimed in claim 3, characterized in that the first bottom face (12) of the first protrusion (11) of each first plate (2) contacts the second top face (29) of the second bottom part (28) of the adjacent second plate (22) over at least a part of its length, and in that the second bottom face (32) of the second protrusion (31) of each second plate (22) contacts the first top face (9) of the first bottom part (8) of the adjacent first plate (2) over at least a part of its length, in each position of the mould halves (1, 21) with respect to each other.

5. A mould as claimed in claim 2, characterized in that each of the first and second protrusion (11, 31) protrudes from a first, respectively second plate (2, 22) towards the next first, respectively second plate (2, 22), in longitudinal direction of the mould (42) over a distance that is at least equal to a thickness of the first, respectively second plate (2, 22).

6. A mould as claimed in claim 1, characterized in that the mould halves (1, 21) are displaceable with respect to each other in width direction of the mould (42) in such a way that the distance between the first (3) and second (23) inner side walls on opposite sides of the mould cavity (59) may be varied.

7. A mould as claimed in claim 1, characterized in that the mould cavity (59) comprises a cavity bottom (49), and in that the first (5) and second (25) end walls of respectively the first (2) and second (22) plates are sloping in a direction pointing away from the cavity bottom (49).

8. A mould as claimed in claim 1, characterized in that the longitudinal side walls (3, 23) of the mould cavity (59) comprise respectively first and second means (14, 34) for guiding a material part when being pressed into the mould cavity (59).

9. A mould as claimed in claim 8, characterized in that each first (2) and second (22) plate comprises, at a position where a top face (6, 26) of the first respectively second plate (2, 22) transfers to the first, respectively second end wall (5, 25), respectively a first and second recess (15, 35) for receiving respectively the first and second means (14, 34) for guiding the material part.

10. A mould as claimed in claim 8, characterized in that the first and second means for guiding the material part comprise respectively a first and second axle (14, 34) in respectively the first and second mould halve (1, 21), the first and second axle (14, 34) extending in longitudinal direction of the mould (42).

11. A mould as claimed in claim 10, characterized in that each of the first and second axles (14, 34) is rotatable about its longitudinal axis.

12. A mould as claimed in claim 1, characterized in that the first and second mould halve (1, 21) respectively comprise first and second connecting means (13, 33; 16, 36; 18, 38) for removably connecting respectively the first and second plates (2, 22).

13. A mould as claimed in claim 12, characterized in that the first and second connecting means (13, 33; 16, 36; 18, 38) respectively comprise a first and second axle (16, 36) extending in longitudinal direction of the mould (42), a first and second cavity (13, 33) extending throughout respectively the first and second protrusion (11, 31) and the first and second plate (2, 22) for receiving respectively the first and second axle (16, 36), and means (18, 38) for connecting the axle (16, 36) to the plate (2, 22).

* * * * *